United States Patent [19]

Glauner et al.

[11] 4,211,204

[45] Jul. 8, 1980

[54] GLOW PLUG ARRANGEMENT

[75] Inventors: Jens Glauner, Tamm; Günther Kauhl, Affalterbach; Hannes Pflug, Gerlingen; Leo Steinke, Waiblingen-Hegnach; Helmut Weyl, Schwieberdingen, all of Fed. Rep. of Germany

[73] Assignee: Robert Bosch GmbH, Stuttgart, Fed. Rep. of Germany

[21] Appl. No.: 942,078

[22] Filed: Sep. 13, 1978

[30] Foreign Application Priority Data

Oct. 15, 1977 [DE] Fed. Rep. of Germany ..... 2746496

[51] Int. Cl.[2] ..... F02M 57/00

[52] U.S. Cl. ..... 123/145 A; 361/98; 123/145 R

[58] Field of Search ..... 123/145 A, 145 R, 143 C, 123/184, 143 R, 143 B, 169 EL, 32 C, 32 JP; 317/94, 98; 60/39.82 N; 313/137, 144

[56] References Cited

U.S. PATENT DOCUMENTS

| | | | |
|---|---|---|---|
| 2,487,924 | 11/1949 | Fiedler | 123/145 A |
| 3,297,914 | 1/1967 | Saintsbury | 123/145 R |
| 3,407,794 | 10/1968 | Nagai et al. | 123/145 |
| 3,434,012 | 3/1969 | Rademacher | 123/145 A |

FOREIGN PATENT DOCUMENTS

| | | | |
|---|---|---|---|
| 861275 | 2/1961 | Fed. Rep. of Germany | 123/145 |
| 1127454 | 9/1968 | Fed. Rep. of Germany | 123/145 |
| 761082 | 3/1934 | France | 123/145 |

*Primary Examiner*—Charles J. Myhre
*Assistant Examiner*—Raymond A. Nelli
*Attorney, Agent, or Firm*—Frishauf, Holtz, Goodman & Woodward

[57] ABSTRACT

To heat the glow plug for an internal combustion engine, a spiral band or ribbon is wound in an essentially co-planar spiral about a central bolt secured to the bottom of the glow plug, the outer terminal of the spiral being connected to a lead-in with highly positive temperature coefficient of resistance to provide for self-limiting current flow upon heating of the glow plug. All free spaces in the glow plug are filled with a highly heat-conductive insulating material, for example magnesium oxide.

10 Claims, 2 Drawing Figures

GLOW PLUG ARRANGEMENT

The present invention relates to a glow plug, and more particularly to the internal arrangement of a glow plug for use in preheating the combustion space of an internal combustion engine such as an automotive-type Diesel engine.

BACKGROUND AND PRIOR ART

Various type of glow plugs have previously been proposed, one glow plug, for example, being described in German Patent Publication 1,526,775, (corresponding to British Pat. No. 1,127,454) which uses a spiral ribbon as the heating element. The spiral ribbon of this type of glow plug is exposed to the combustion gases and to the inside of the combustion space of the engine, and thus requires special material which can withstand the severe enviromental conditions pertaining within the combustion of an internal combustion engine, including the very high temperatures, exposure to corrosive gases, and the like.

Closed, protected glow plugs, for use in internal combustion engines have been proposed and are generally known and described in the literature - see German Patent 1,119,598 (corresponding to British Pat. No. 861,275) and U.S. Pat. No. 3,407,794, in which the latter is a glow plug which also includes a fuel supply thereto. A detailed description of the art of glow plugs is, thus, not necessary since these are structures which are well known.

THE INVENTION

It is an object to provide a glow plugs which has the advantages of the simplicity of structural arrangement and manufacture of a ribbon-type heater element, but which is easier and cheaper to make than known glow plugs.

Briefly, the glow plug includes a heater element formed as a band wound in an essentially co-planar spiral winding which is located within a closed tubular housing, close to the closed end of the glow plug, the spirals of the ribbon being separated from each other by an insulating material. The glow plug itself is filled with an insulating material of good heat-conductive characteristics, in which also the spiral is embedded. Preferably, the glow plug is formed with an internally projecting post at the inner end thereof to which one end of the spiral ribbon is attached, for example by welding, the other end being connected to a connecting wire.

The glow plug has the advantage that the material to be used for the ribbon need not be the expensive material which is capable of resisting of the environmental conditions within the combustion chamber of an internal combustion engine but, rather, can be made of a material resistant only to much lower temperatures and which is enclosed in an insulating embedding material.

Drawings, illustrating a preferred example:

Figure 1:
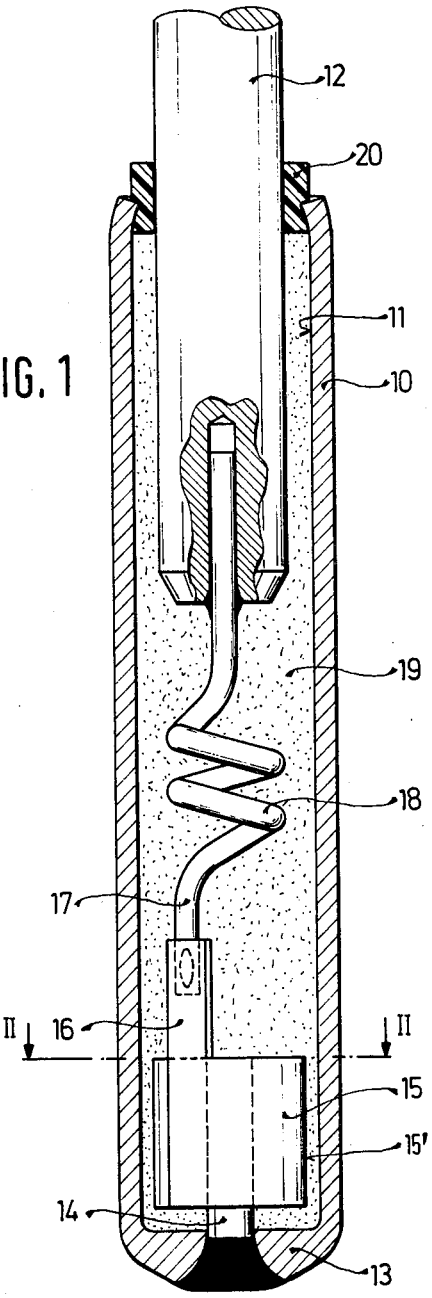
FIG. 1 is a longitudinal cross-sectional view through the glow plug.
Figure 2:
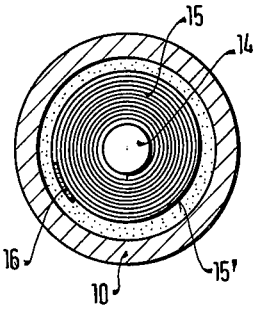
FIG. 2 is a highly schematic section taken along lines II—II.

A closed tube 10, closed off at 13 at the bottom, has an interior space 11 through which a connecting bolt 12 extends. The bottom 13 has an internally projecting bolt 14 secured thereto which is securely connected to the end 13, for example by welding. Bolt 14 has a ribbon heater element 15 secured thereto which then is spirally wound thereabout. The various windings of the ribbon element 15 are separated from each other by an insulating layer 15'. In a preferred form, the windings are insulated with respect to each other and tightly wound upon each other. They are slightly spaced from the bottom inner wall of the tube 13, as is clearly apparent from FIG. 1. The outer contour of the heater element 15 is located close to the inner wall of the glow tube 10. The outer end portion of the heater element 15 is extended and formed with a connecting flag 16 to which a connecting lead 17 is attached. Connecting lead 17 is secured at its other end to the connecting bolt 12, for example by welding. Preferably, the lead 17 is not straight but has a few spiral windings to permit thermal expansion compensation. Preferably, the connecting lead 18 is formed of a material having a highly positive temperature coefficient of resistance, which results in rapid heating of the heater element 15 but prevents danger of over-heating, and thus self-destruction since the wire 18, upon being heated, will substantially increase its resistance and thus provide a self-limiting effect with respect to current through the glow plug. The portion of the interior 11 which is not taken up by the elements described is filled with a material which is insulating but good heat-conducting, for example magnesium oxide. The open end of the glow plug 10 has a sealing ring 20 introduced thereto which holds the bolt 12 in position. The tube 10 is crimped to bite into the sealing ring 20. The material 19, filling the glow plug, is compacted after the glow plug has been assembled and sealed by crimping the end into sealing ring 20. It can be compacted by hammering, rolling, swaging, or the like, to provide for radial reduction of the glow plug and tight compaction of material 19 to improve its heat conductivity.

The connecting lead 17 is connected to the bolt 12 and to the flag 16, preferably, by welding. Flag 16 can be unitary with the spiral ribbon 15; it may be formed, however, also by a short reverse wrap of the spiral of the winding 15. The electrical resistance of the heating element 15, preferably, is between 0.3 and 0.5 ohms, but it may vary, depending on the intended use, between 0.1 and 1 ohm, when used in automotive applications having a 12 V on-board electrical network.

In an actual example, for connection to a 12 V network, the heater band 15 is made of a Fe-Cr-Al alloy having an axial dimension of 3 mm, and a linear length of 6 cm. The thickness of the band is 0.1 mm, making approx. 6÷7 turns about a center bolt of approximately 1.6 mm. The insulation applied to the resistance ribbon 15 is in layer form and is a layer of 0.1 mm thickness of $Al_2O_3$.

Various changes and modifications may be made within the scope of the inventive concept.

We claim:

1. Glow plug arrangement comprising a tubular housing (10) closed at one end thereof;

a spiral heating element (15) formed as a heating band or ribbon wound in an essentially co-planar spiral winding, positioned adjacent the closed end of the glow plug;

an insultating layer or coating on one side of the ribbon to insulate the turns of the ribbon from each other;

and an electrically insulating, good heat-conductive material (19) filling the closed tubular housing and embedding said spiral heating element therein.

2. Glow plug according to claim 1, wherein the windings of the heating element - insulating layer combination are tight against each other.

3. Glow plug according to claim 2, further including a central bolt (14) secured to the closed end of the housing (13), the spiral heating element being connected to said central bolt and wrapped thereabout;

a connecting pin or bolt (12) passing into the housing and insulated therefrom;

and a connecting lead (17) including at least one spiral turn (18) connecting the outer end of the spirally wound band or ribbon heating element (15) and the connecting ping or bolt, said connecting lead including said turn comprising a material with highly positive temperature coefficient of resistance;

and an insulating material filling all free spaces within the tube, the tube and the insulating material therein being radially compacted, the outer winding loop of the spiral band or ribbon heating element (15) being positioned close to the iner wall of the tubular housing.

4. Glow pulg according to claim 1, further including a central bolt (14), the windings of the spiral heating element being wrapped around said bolt.

5. Glow plug according to claim 4, wherein the bolt is secured to the closed end (13) of the tubular housing (10).

6. Glow plug according to claim 1, wherein the outer circumference of the spirally wound band or ribbon of the heating element is close to the inner wall of the tubular housing (10).

7. Glow plug according to claim 1, further including a wire lead conductor (17) secured to the band or ribbon forming the spiral heating element;

a connecting pin or bolt (20) passing into the tubular housing and insulated therefrom, the lead (17) being secured to the connecting pin or bolt.

8. Glow plug according to claim 7, wherein the lead wire (17) connecting the pin or bolt (20) and the spiral heating element includes at least one spiral turn (18) to form a compensating winding.

9. Glow plug according to claim 7, wherein the lead conductor comprises a material having a strongly positive temperature coefficient of resistance.

10. Glow plug according to claim 1, further including an insulating material (19) filling the tubular housing (10) and all free spaces therein, said insulating material being radially compacted.

* * * * *